US009414644B2

(12) United States Patent
Wang

(10) Patent No.: US 9,414,644 B2
(45) Date of Patent: Aug. 16, 2016

(54) COSTUME STYLE SHOE BODY AND MANUFACTURING METHOD THEREOF

(71) Applicant: Joy Sewing King & World Prosperity Co., Ltd., Taipei (TW)

(72) Inventor: Bo-Chun Wang, Taipei (TW)

(73) Assignee: JOY SEWING KING & WORLD PROSPERITY CO., LTD., Taipei (TW)

( * ) Notice: Subject to any disclaimer, the term of this patent is extended or adjusted under 35 U.S.C. 154(b) by 343 days.

(21) Appl. No.: 13/907,764

(22) Filed: May 31, 2013

(65) Prior Publication Data

US 2013/0318822 A1 Dec. 5, 2013

(30) Foreign Application Priority Data

Jun. 5, 2012 (TW) ..... 101210805 A

(51) Int. Cl.

| | |
|---|---|
| ***A43B 3/00*** | (2006.01) |
| ***A43B 3/14*** | (2006.01) |
| ***A43B 23/02*** | (2006.01) |
| ***A43B 23/24*** | (2006.01) |
| ***A43B 23/04*** | (2006.01) |
| ***A43B 3/24*** | (2006.01) |

(52) U.S. Cl.

CPC ..... *A43B 23/24* (2013.01); *A43B 3/248* (2013.01); *A43B 23/025* (2013.01); *A43B 23/042* (2013.01)

(58) Field of Classification Search

CPC .... A43B 23/029; A43B 23/042; A43B 23/24; A43B 3/106; A43B 3/248

USPC ..... 36/47, 46, 45; 12/146 C

See application file for complete search history.

(56) References Cited

U.S. PATENT DOCUMENTS

| | | | | |
|---|---|---|---|---|
| 336,214 | A * | 2/1886 | Cosart | A43B 13/145 36/25 R |
| 1,365,072 | A * | 1/1921 | Abramowitz | A43B 23/0295 36/11 |
| 1,422,233 | A * | 7/1922 | Stern | B65D 85/58 206/338 |

(Continued)

FOREIGN PATENT DOCUMENTS

| | | | |
|---|---|---|---|
| CA | 2777604 | A1 | 4/2011 |
| CN | 85200792 | U | 1/1986 |
| CN | 2398863 | Y | 10/2000 |

(Continued)

OTHER PUBLICATIONS

Office action issued on Jan. 12, 2015 from SIPO in a counterpart Chinese Patent Application No. 201310214726.0.

Office action issued on Aug. 25, 2015 from JPO in a counterpart Japanese Patent Application No. 2013-115526.

*Primary Examiner* — Jila M Mohandesi

(74) *Attorney, Agent, or Firm* — The PL Law Group, PLLC

(57) ABSTRACT

The present invention discloses a costume style shoe body and a manufacturing method thereof, the costume style shoe body comprising a main body, an insole, and an outsole. The main body is formed by designing the shoe style and then making a new mold, and cutting the shoe material into a predetermined shape, wherein a main body sole is formed to be fully waterproof by machine sewing the insole and the outsole together, the shoe surface of the main body having a plurality of flaps around the main body and extended upward from the main body sole, wherein the plurality of flaps forms a container portion with an opening by machine sewing, the opening is disposed with a fastening portion having buckles designed with a costume style or a shoe lace of a selected color.

7 Claims, 8 Drawing Sheets

(56) References Cited

U.S. PATENT DOCUMENTS

| | | | | | |
|---|---|---|---|---|---|
| 2,384,927 | A | * | 9/1945 | Julianelli | A43B 23/025 36/11 |
| 2,611,977 | A | * | 9/1952 | Yamada | A43B 3/106 36/11.5 |
| 2,974,427 | A | * | 3/1961 | Wolff | A43B 3/14 36/11 |
| 5,604,997 | A | * | 2/1997 | Dieter | A43B 23/042 12/146 C |

FOREIGN PATENT DOCUMENTS

| | | | |
|---|---|---|---|
| CN | 2498874 | Y | 7/2002 |
| CN | 101744406 | A | 6/2010 |
| JP | 365581 | Z | 6/1950 |
| JP | 56-70701 | A | 6/1981 |
| JP | 2001-95602 | A | 4/2001 |
| JP | 2001-299411 | A | 10/2001 |
| JP | 2003-102511 | A | 4/2003 |
| JP | 2008-543452 | A | 12/2008 |
| WO | 2011/082391 | A1 | 7/2011 |

* cited by examiner

COSTUME STYLE SHOE BODY AND MANUFACTURING METHOD THEREOF

BACKGROUND OF THE INVENTION

1. Field of the Invention

The present invention relates to a costume style shoe body, and more particularly, to a costume style shoe body which is formed in one piece, fitted, comfortable to wear, fully waterproof and designed with a costume style, and a manufacturing method thereof.

2. Description of the Prior Art

The development of shoes has been going on for centuries with lots of great designs. In recent years, new shoe types are usually improved models from previous designs with no overall renovations. Therefore, it is common that a shoe design stressed on comfortable features could be inconvenient to wear and lack of esthetic design; on the other hand, a shoe design stressed on convenience could be loose in structure and could be damaged easily. Moreover, a shoe design stressed on multiple functions could have more constructing elements and have more seams in between the elements, making it prone to damaging, inconvenient to repair, and easy to be infiltrated with water. Therefore, such shoe designs are not giving users good wearing experiences.

In order to enhance the durability of a shoe body, it is necessary to reduce the number of constructing elements; however, for convenient wearing and comfortable wearing experiences, the traditional shoe design cannot use a one-piece shoe body.

Therefore, the present invention discloses an improve shoe body structure, wherein a single shoe material is cut into a shoe surface in one piece to enhance the structural strength and waterproof capability. Besides, the present invention discloses a shoe surface with a fastening portion, which comprises a costume style button or buckle, or a shoe lace of a selected color disposed thereon to enhance the decorative appearance of the shoe design and to make it more popular. Furthermore, the costume style fastening element, such as the button/buckle or shoe lace, can work with the shoe body to provide wearing and decorative functions.

In view of the above-described deficiencies of the traditional shoe designs, after years of constant effort in research, the inventor of this invention has consequently developed and proposed a costume style shoe body and a manufacturing method thereof

SUMMARY OF THE INVENTION

It is an object of the present invention to provide a costume style shoe body and a manufacturing method thereof, which comprises a one piece structure and is waterproof to provide the best protection to the foot of the wearer.

It is another object of the present invention to provide a costume style shoe body and a manufacturing method thereof, which is formed based on costume designs to go with different costumes.

It is another object of the present invention to provide a costume style shoe body and a manufacturing method thereof, which provides a complete fastening structure for the user to wear the shoe body comfortably and firmly.

In order to achieve the above objects, the present invention discloses a costume style shoe body comprising:

a main body, an insole, and an outsole, wherein the main body is formed by forming a sole shape and a costume style shoe surface thereof in one piece. The main body is formed by designing the shoe style and then making a new mold, and cutting the shoe material into a predetermined shape, wherein a main body sole is formed to be fully waterproof by machine sewing the insole and the outsole together; the sole of the main body having a plurality of flaps around the main body and extended upward from the main body sole, wherein the plurality of flaps forms a container portion with an opening by machine sewing neighboring flaps with each other at the sides of the flaps; the outsole having engagement portions disposed at the front and the rear thereof for the heel to engage with the outsole, wherein the heel is designed with different styles and colors to go with the costume.

The shoe face around the opening is disposed with a fastening portion having buckles designed with a costume style or a shoe lace of a selected color, the fastening portion can be further fastened with the buckle or the shoe lace for a user to wear the shoe and fasten the shoe and the foot together.

DETAILED DESCRIPTION OF THE PREFERRED EMBODIMENT

Figure 1:
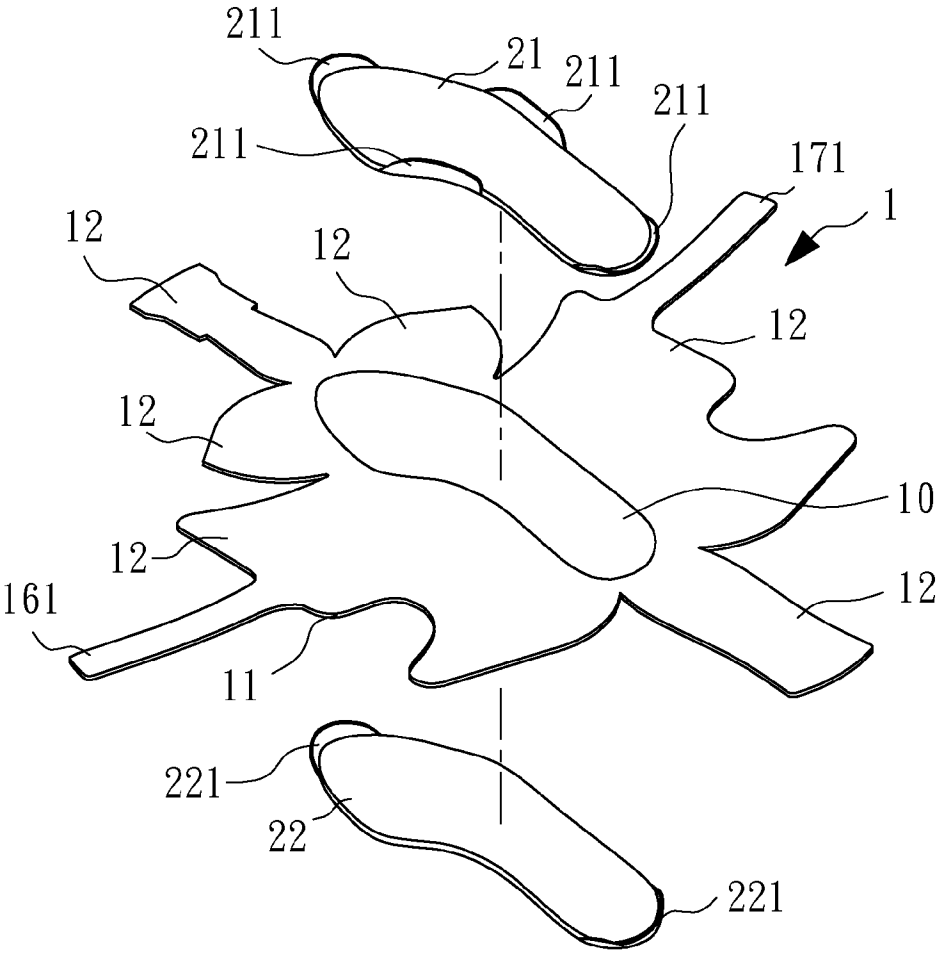
FIG. 1 illustrates a perspective view of the structure of the present invention.
Figure 2:
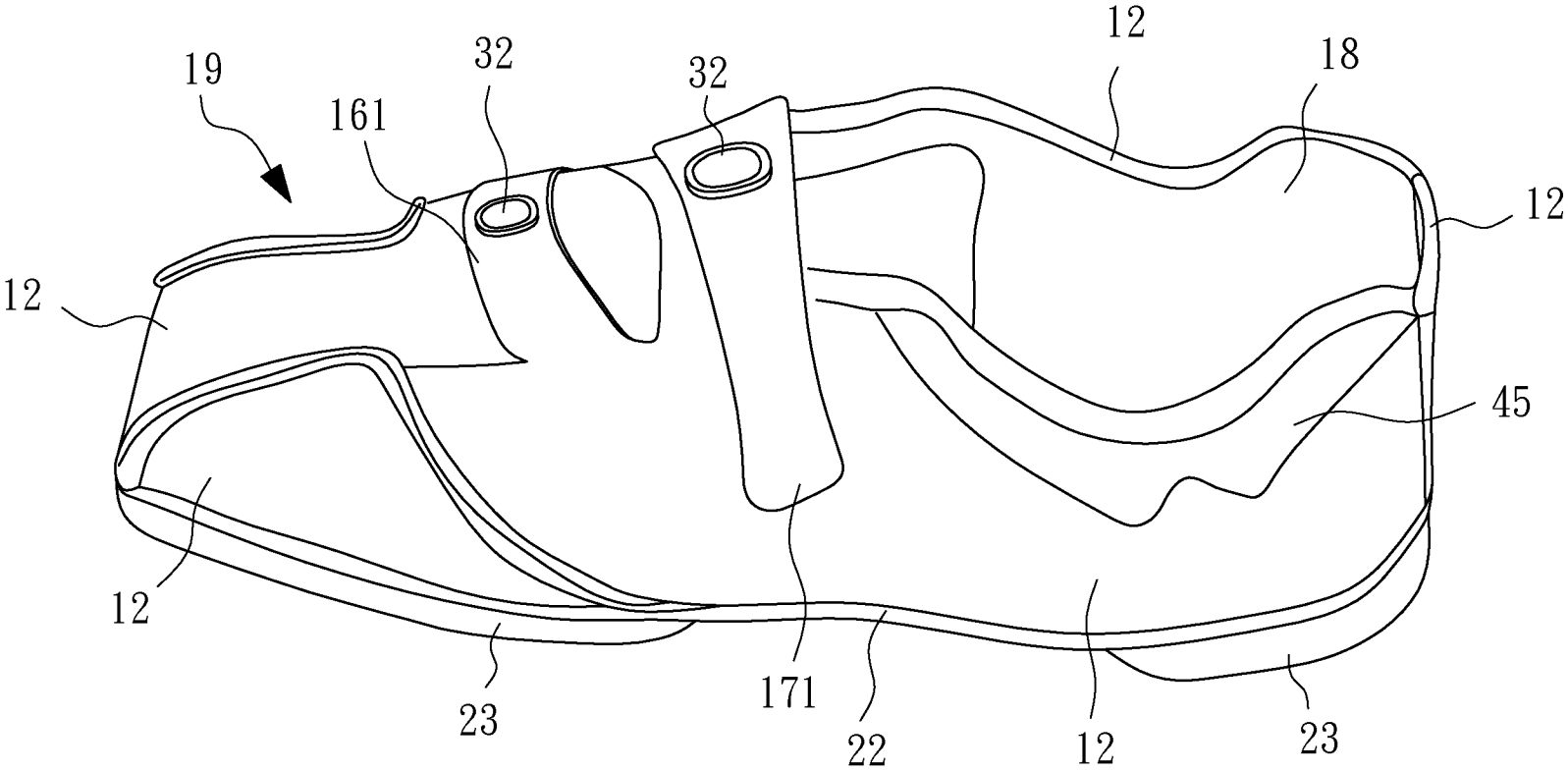
FIG. 2 illustrates a view of a shoe made of the structure of the present invention.
Figure 3:
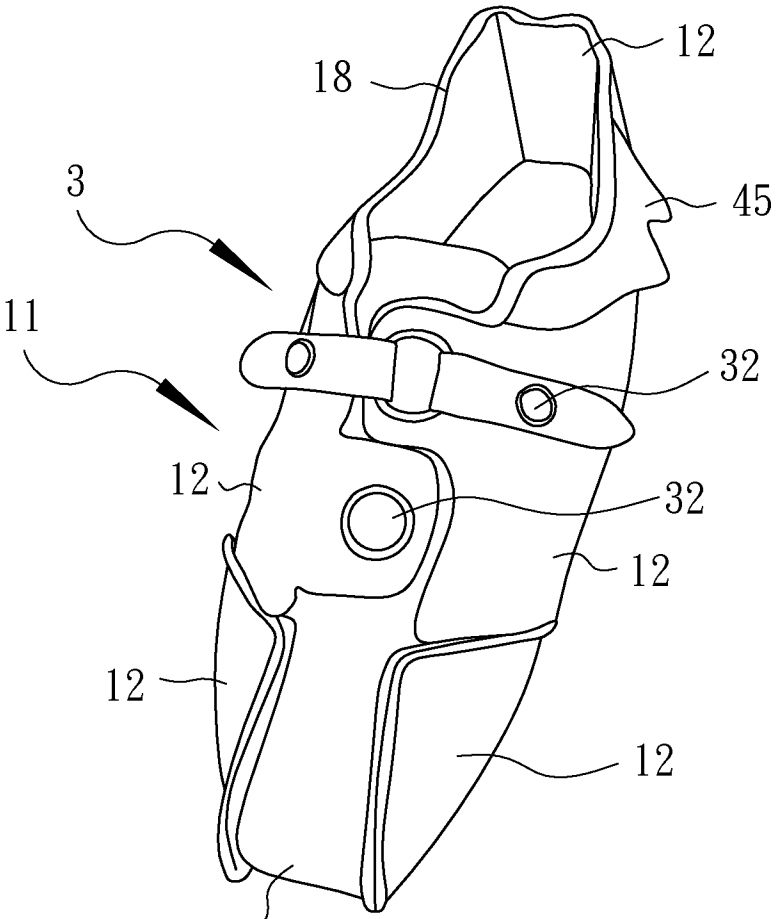
FIG. 3 illustrates a view of a first embodiment of the present invention.
Figure 4:
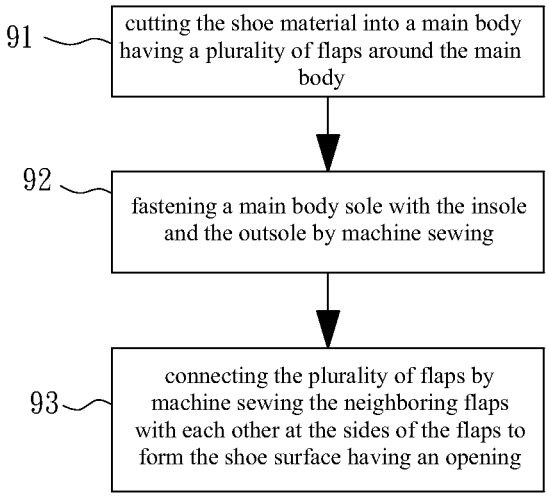
FIG. 4 illustrates a flow chart of the manufacturing method of the present invention.

The advantages and innovative features of the invention will become more apparent from the following detailed description when taken in conjunction with the accompanying drawings.

Please refer to FIG. 1 to FIG. 4 for a costume style shoe body disclosed in the present invention. The shoe body comprises a main body 1, two symmetrical soles are an insole 21 and an outsole 22; the main body 1 is formed by designing the shoe style and then making a new mold, and cutting the shoe material 11 into a predetermined shape, wherein a main body sole 10 is formed to be fully waterproof by machine sewing the insole 21 and the outsole 22 together; the sole 10 of the main body 1 having a plurality of flaps 12 around the main body and extended upward from the main body sole, the insole 21 having a plurality of insole eaves 211 extended from the perimeter thereof, wherein the plurality of insole eaves 211 forms a angle with respect to the insole; the outsole 22 is fixed to an outer bottom of the main body sole 10 by machine sewing, the outsole 22 having a plurality of outsole eaves 221 extended from the perimeter thereof, wherein the plurality of outsole eaves 221 forms a angle with respect to the outsole 22; the angle formed by the insole eaves 211 and the insole 21 and the angle formed by the outsole eaves 221 and the outsole 22 both larger than 90 degrees; besides, the outsole 22 having engagement portions disposed at the front and the rear thereof for a heel 23 to engage with the outsole, wherein the heel 23 is designed with different styles and colors to go with the costume.

When manufacturing the costume style shoe body, the shoe surface, insole, and outsole are formed in one piece, while the traditional shoe body is formed by separately building the sole and the shoe surface and then combining them together; besides, the shoe body is formed by cutting the shoe material into one piece and then machine sewing the shoe material from the bottom to the top, the steps comprising:

step 1: cutting the shoe material 11 into a main body 1 having a plurality of flaps 12 around the main body;

step 2: fastening the main body 1 with the insole 21 and the outsole 22 by machine sewing them together to form a main body sole 10;

step 3: connecting the plurality of flaps 12 by machine sewing the neighboring flaps 12 with each other at the sides of the flaps 12 to form the shoe surface 19 having an opening 18.

The shoe face 19 around the opening 18 is disposed with a fastening portion 3 having buckles designed with a costume style or a shoe lace of a selected color, so the fastening portion 3 can look like a designed costume. Furthermore, since the shoe body is formed in one piece and the shoe material 11 is waterproof, the shoe body can be formed into a fully sealed, solid and fully waterproof structure by machine sewing.

Furthermore, in the step 1, the shoe material 11 is cut into the main body 1 according to different styles or functions, for example, the flaps 12 on two sides of the main body can have lock straps 161 and 171 extended therefrom. When a user is wearing the shoes, the lock straps 161, 171 can be fixed to the flap 12 on the other side of the shoe body by Velcro or other equivalent ways. In this way, it is not necessary to sew the lock strap to the shoe surface, thereby reducing the number of steps in the process and providing better wearing experiences.

Figure 5:
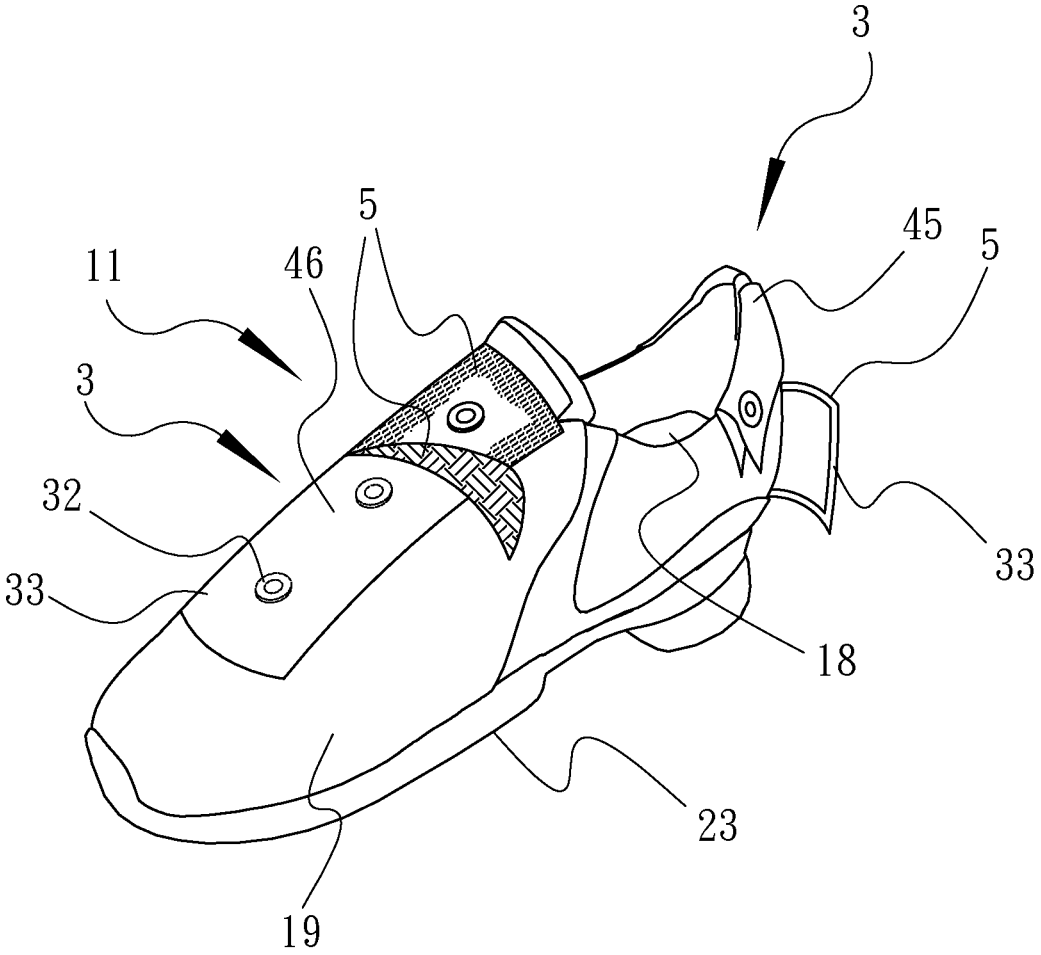
FIG. 5 illustrates a view of a second embodiment of the present invention.
Figure 6:
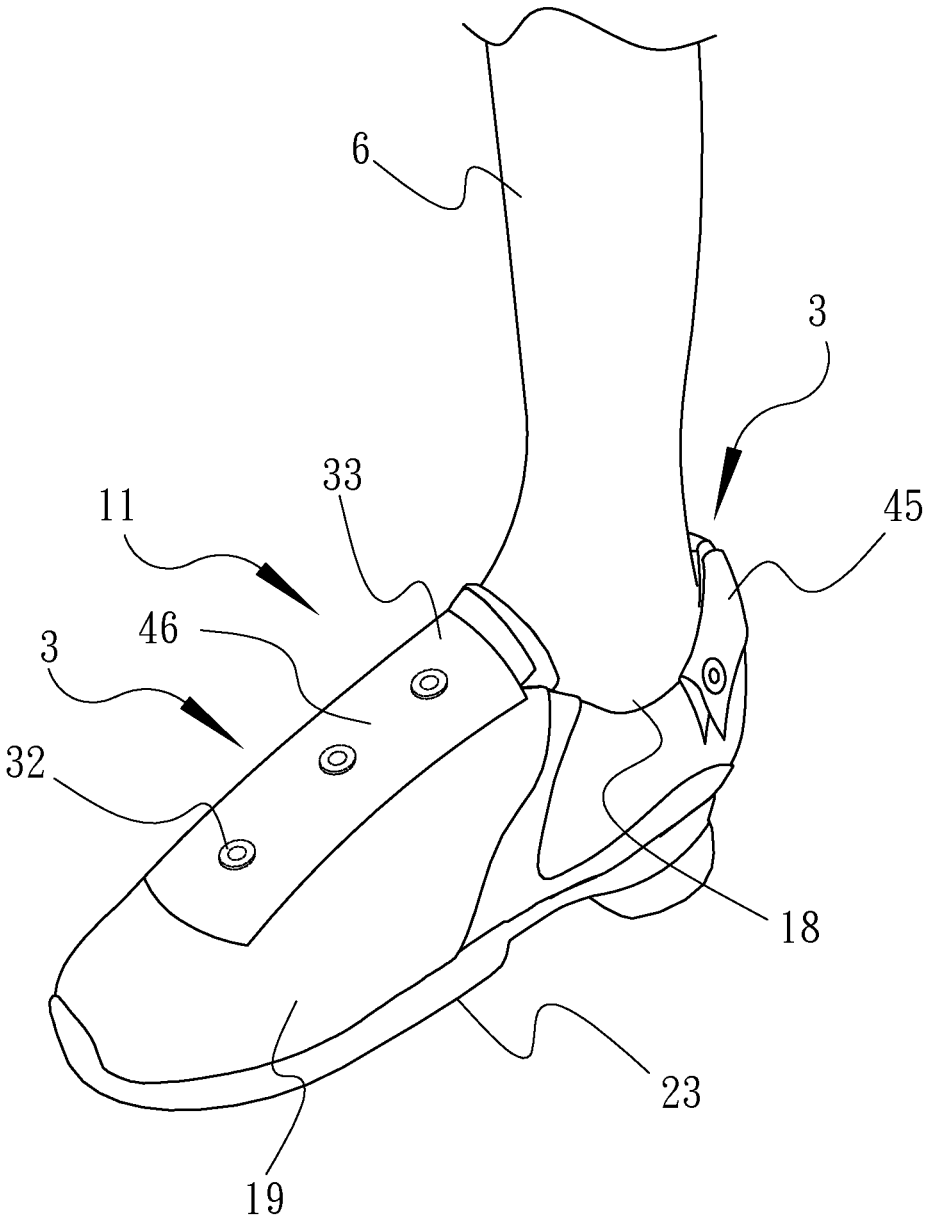
FIG. 6 illustrates a view of a user wearing the shoe in a third embodiment of the present invention.

There are various implementations for the fastening portion 3, as shown in FIG. 5 and FIG. 6, the fastening portion 3 at the front comprises a costume style of a lapel 46, fastening portion 3 at the rear comprises a costume style of a collar 45; overall, the shoe surface 19 is designed to look like a shirt. For fixing purpose, the fastening portion 3 can have buttons or buckles 32 disposed at the eyelet of the shoe surface to correspond to the collar 45 costume style of the rear fastening portion 3 of the shoe surface 19, the same way as designing a shirt; or fastening portion 3 can have buttons or buckles 32 disposed to facilitate the fixing operation of the fastening portion 3. The shoe surface 19 can be embroidered with 3D patterns, decorative lines, or various colors to present a stronger image of the shoe.

There can be a plurality of buttons or buckles 32 for adjusting the tightness between the shoe surface 19 and the foot 6 to make it comfortable. Furthermore, in order to strengthen the fixing effect of the buttons or buckles 32, the buttons or the buckles 32 are disposed with a fastening mat 33 on an outside thereof to further fix the buttons or the buckles to the shoe surface 19, and the fastening mat 33 can be a Velcro 5 or other equivalent mechanism.

Figure 7:
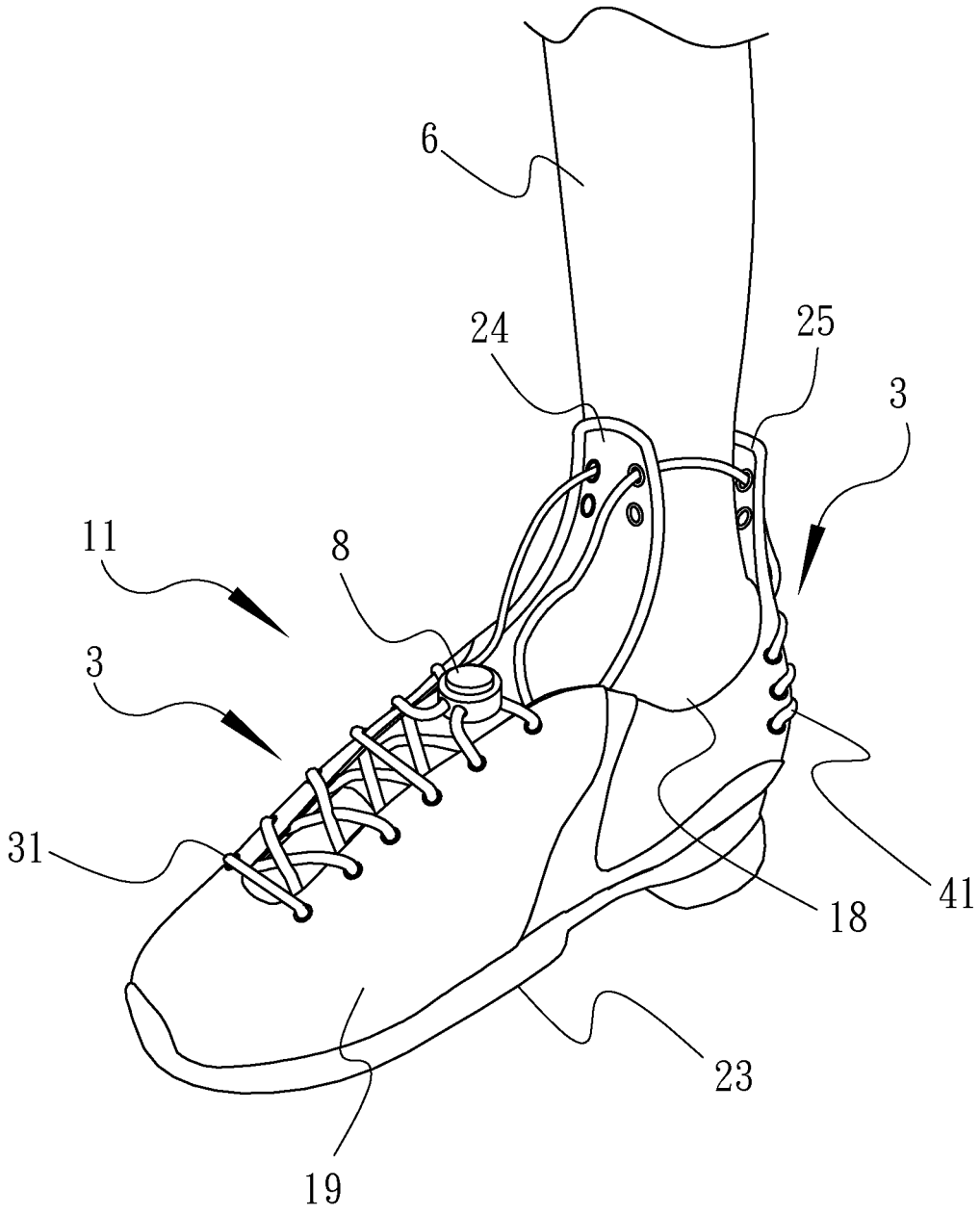
FIG. 7 illustrates a view of a fourth embodiment of the present invention.

Also shown in FIG. 6 and FIG. 7, the fastening portion 3 can comprise shoe laces of different colors, when the shoe body is disposed with the same shoe lace both at the front or the rear thereof, the fastening portion 3 can have a front shoe lace 31 disposed at the front, and a rear shoe lace 41 disposed at the rear, the front and rear shoe laces 31, 41 are both disposed on the shoe surface 19 when the shoe body is formed; the front and rear shoe laces 31, 41 are disposed with a turn-buckle 8 therebetween to facilitate fast loose or tie-up operations. Besides, the rear shoe lace 41 can be disposed right behind the front shoe lace 31 and goes around the opening 18 to reach the shoe surface 19 at the rear to tighten up the opening 18 and further fixing the foot to the shoe. In the embodiment, the opening 18 has two tongues 24, 25 each extended upward from the front and rear of the shoe surface to let the rear shoe lace 41 go through the tongues 24, 25 and end up at a higher place of the foot 6 than the opening for fastening operation.

Figure 8:
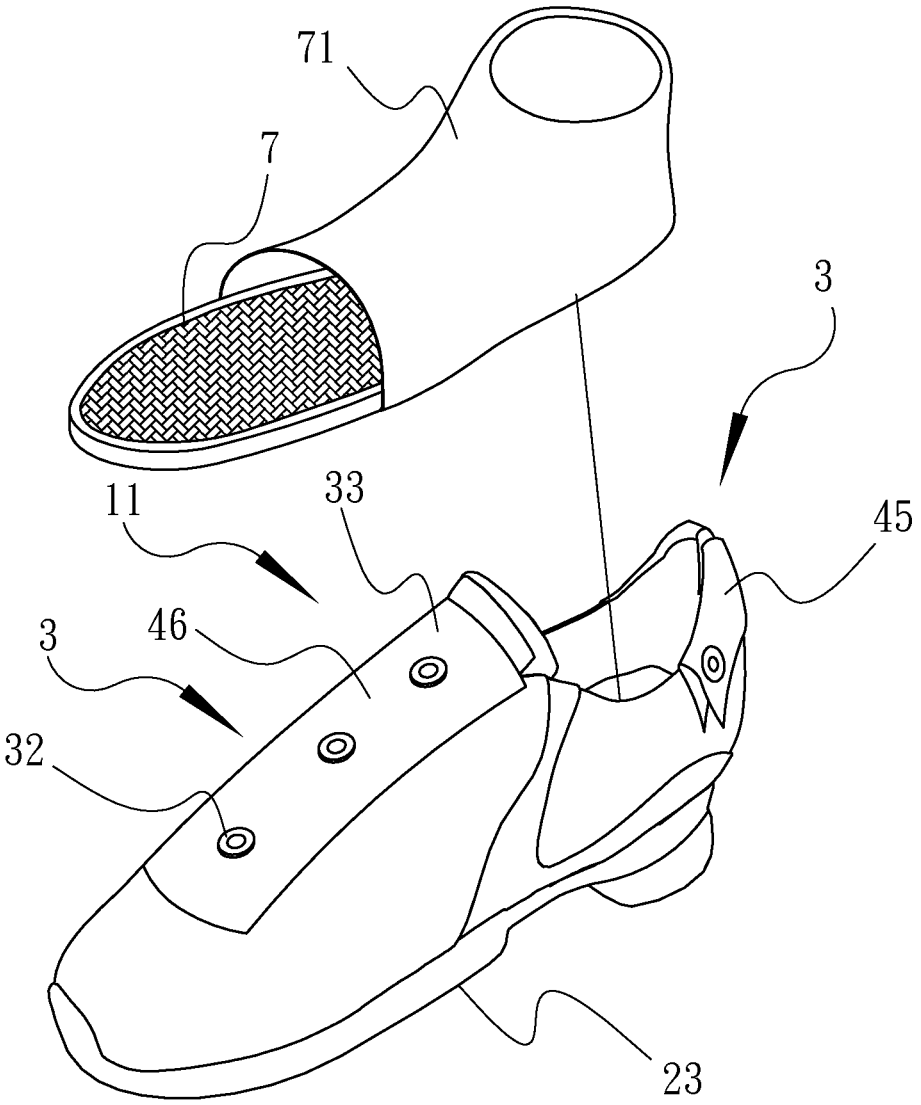
FIG. 8 illustrates a view of the shoe having a pad which can act as a standalone slipper in the present invention.

Please refer to FIG. 8, the present invention can also include a pad 7 which can act as a slipper as well, the pad 7 comprises an inner pad and an outer pad clipping the colored flexible cloth of the container portion 71 by machine sewing, the inner pad is made of a material which is comfortable to wear, the container portion 71 is provided for holding the foot 6, thereby allowing the pad 7 to act as both a slipper for indoor use or to be inserted in the shoe body when going out.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A method for manufacturing a costume style shoe body by forming a sole shape and a shoe surface of the shoe body in one piece and machine sewing an insole, an outsole, and a shoe material together from the bottom to the top, wherein the insole and the outsole are two symmetrical soles, the outsole has a plurality of outsole eaves extended from a perimeter thereof, and the plurality of outsole eaves form a first angle with respect to the outsole, the insole has a plurality of insole eaves extended from a perimeter thereof, the plurality of insole eaves form a second angle with respect to the insole, comprising:

step 1: cutting the shoe material into a main body having a plurality of flaps around the main body;

step 2: fastening the main body with the insole and the outsole by machine sewing to form a main body sole; and step 3: connecting the plurality of flaps by machine sewing the neighboring flaps with each other at the sides of the flaps held upwardly by the pluralities of insole eaves and outsole eaves to form the shoe surface having an opening, wherein the outsole has an engagement portion disposed at one of the front and the rear thereof for a heel to engage with the outsole.

2. The method for manufacturing a costume style shoe body as claimed in claim 1, wherein the first angle and the second angle are larger than 90 degrees.

3. The method for manufacturing a costume style shoe body as claimed in claim 1, wherein the opening is disposed with a fastening portion having a button or a buckle at a front or rear of the opening or the shoe surface.

4. The method for manufacturing a costume style shoe body as claimed in claim 3, wherein the button or the buckle of the fastening portion is disposed at an eyelet of the shoe surface and is disposed at either the front, rear or both of the opening.

5. The method for manufacturing a costume style shoe body as claimed in claim 3 wherein the fastening portion is disposed with the button or the buckle of a designed style to fix the shoe surface.

6. The method for manufacturing a costume style shoe body as claimed in claim 1, wherein the flaps on two sides of the main body have a lock strap extended therefrom, when a user is wearing the shoes, the lock strap is fixed to the flap on the other side of the shoe body.

7. A method for manufacturing a costume style shoe body by forming a sole shape and a shoe surface of the shoe body in one piece and machine sewing an insole, an outsole, and a shoe material together, wherein the outsole has a plurality of outsole eaves extended from a perimeter thereof, and the plurality of outsole eaves form a first angle with respect to the outsole, the insole has a plurality of insole eaves extended from a perimeter thereof, the plurality of insole eaves form a second angle with respect to the insole, comprising:

step 1: cutting the shoe material into a main body having a plurality of flaps around the main body;

step 2: fastening the main body with the insole and the outsole by machine sewing to form a main body sole; and step 3: connecting the plurality of flaps by machine sewing the neighboring flaps with each other at the sides of the flaps held upwardly by the pluralities of insole eaves and outsole eaves to form the shoe surface having an opening.

* * * * *